US009593906B1

(12) United States Patent
Oz et al.

(10) Patent No.: US 9,593,906 B1
(45) Date of Patent: Mar. 14, 2017

(54) ELECTRO-OPTICAL OPTIC SIGHT

(71) Applicant: HARTMAN OPTICS LTD., Kiryat Gat (IL)

(72) Inventors: Moshe Oz, Tel Aviv (IL); Mickey (Michael) Hartman, Gedera (IL)

(73) Assignee: WIDE VIEW OPTICS LTD., Kiryat Gat (IL)

( * ) Notice: Subject to any disclaimer, the term of this patent is extended or adjusted under 35 U.S.C. 154(b) by 0 days.

(21) Appl. No.: 14/840,080

(22) Filed: Aug. 31, 2015

(51) Int. Cl.
*F41G 1/473* (2006.01)
*F41G 1/30* (2006.01)
*F41G 1/34* (2006.01)

(52) U.S. Cl.
CPC ..... *F41G 1/30* (2013.01); *F41G 1/345* (2013.01); *F41G 1/473* (2013.01)

(58) Field of Classification Search
CPC ... F41G 1/473; F41G 1/12; F41G 3/14; F41G 3/16; F41G 3/165
USPC ..... 89/204, 205, 203; 42/130, 131, 120, 123
See application file for complete search history.

(56) References Cited

U.S. PATENT DOCUMENTS 8,047,118 B1 * 11/2011 Teetzel ..... F41G 1/473 235/414
2007/0214698 A1 * 9/2007 Hung ..... F41G 1/32 42/111
2012/0151816 A1 * 6/2012 Kleck ..... F41G 1/30 42/132
2012/0306642 A1 * 12/2012 Howard ..... A42B 3/046 340/539.11
2012/0327247 A1 * 12/2012 Mironichev ..... F41G 1/32 348/164
2014/0002680 A1 * 1/2014 Thyssen ..... H04N 5/23258 348/208.99
2014/0188385 A1 * 7/2014 McHale ..... F41G 1/473 701/523
2015/0041538 A1 * 2/2015 Teetzel ..... F41A 23/08 235/404

OTHER PUBLICATIONS

European Search Report for European Application No. 16186680 dated Janurary 2, 2017.

* cited by examiner

*Primary Examiner* — Stephen M Johnson
(74) *Attorney, Agent, or Firm* — Pearl Cohen Zedek Latzer Baratz LLP

(57) ABSTRACT

An optic sight assembly for installation on a riffle is disclosed, comprising an electro-optical optic sight unit which comprises a controller unit, a remote control receiver, and an electro-optical unit to project a reticle image; and a corresponding remote control unit to control operational parameters of the electro-optical optic sight. The remote control unit comprises a remote control controller to produce control signals for transmitting to the remote control receiver, and a keypad unit to enable entering control commands to the remote control unit, wherein the electro-optical optic sight is adapted to receive control signals from the remote control unit to control operational parameters of the reticle.

14 Claims, 7 Drawing Sheets

ELECTRO-OPTICAL OPTIC SIGHT

BACKGROUND OF THE INVENTION

Long rifle view finders known in the art generally split to optical and electro-optical groups. Optical viewfinders typically suffer of drawback for having narrow field of view (FOV), and, as a result, if the shooter wishes to aim at a target through the viewfinder, he/she sees the target's vicinity through a narrow field of view and may easily loose eye contact with the target or find it hard to bring the target into the FOV of the viewfinder. Electro-optical viewfinders typically suffer of several drawbacks, including cumbersome arrangement of control buttons with either difficult access if located at the rear of the viewfinder with additional equipment (such as night-vision equipment) located behind the viewfinder, or unintentional operation of control button(s) due to occasional pressing by a body organ or other equipment carried by the shooter when the buttons are located on the side of the viewfinder.

Further, electro-optical viewfinders known in the art are typically operable according to a factory-set operational setup and may not be adapted to a shooter's preferences. Still further, an electro-optical viewfinder highly depends on the availability of fresh batteries to replace a used battery, leaving it vulnerable to a situation that is common at the battlefield where fresh and fully charged batteries are not commonly available.

There is a need for an electro-optical viewfinder that overcomes the above listed drawbacks as well as many others.

SUMMARY OF THE INVENTION

An optic sight assembly for installation on a rifle is disclosed, comprising an electro-optical optic sight unit which comprises a controller unit, a remote control receiver, and an electro-optical unit to project a reticle image; and a corresponding remote control unit to control operational parameters of the electro-optical optic sight. The remote control unit comprises a remote control controller to transmit control signals to the remote control receiver, a keypad unit to enable entering control commands to the remote control unit, wherein the electro-optical optic sight is adapted to receive control signals from the remote control unit to control operational parameters of the reticle.

The optic sight assembly further comprises at least one motion sensor to sense motion of the optic sight assembly and to issue a signal indicative of the motion to the optic sight controller.

In the optic sight assembly, when the input from the motion signal is one of a signal exceeding a predefined level or a series of signals matching a predefined pattern of signals, the state of the optic sight assembly may be changed from dormant to active.

The optic sight assembly further comprises at least one first control button disposed on the rear side of the optic sight assembly, on a facet of the optic sight assembly case that is inclined by an angle $\alpha$ from a plane perpendicular to a longitudinal line of the optic sight assembly, wherein angle $\alpha$ may be in the range of 15°-30° and preferably equal to 20°.

In the optic sight assembly, one first control button is adapted to enable control of at least one of turn on/turn off the optic sight assembly and change the brightness of the reticle image.

In some embodiments in the optic sight assembly, a second control button is disposed on the rear side of the optic sight assembly substantially in the middle of the rear facet of the optic sight case and is adapted to control at least one of sleep mode on/off, night vision mode on/off, sleep mode timer.

In some embodiments, the optic sight assembly further comprises a port disposed on the front facet of the optic sight case, the port adapted to enable serial communication with the controller unit of the optic sight unit and to provide charging power to a rechargeable battery of the optic sight assembly. In some embodiments, the port is a USB port. In some embodiments, the port is adapted to enable a remote computing unit connected via the port to modify values of control parameters of the optic sight assembly.

In some embodiments, the control parameters the values of the optic sight that may be modified by the remote computing unit are at least one of sleep mode timer value, low battery warning time, levels of reticle brightness.

In some embodiments, a remote control transmitter is adapted to transmit a narrow beam that is aimed towards the optic sight unit when the remote control unit is installed on a front portion of a gun. The angle of radiation of the beam may be about 10°.

In some embodiments, control commands entered at the remote control unit are coded on the transmitted narrow beam. In some additional embodiments, the coding of the control commands is unique to the optic sight unit and to its corresponding remote control unit.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
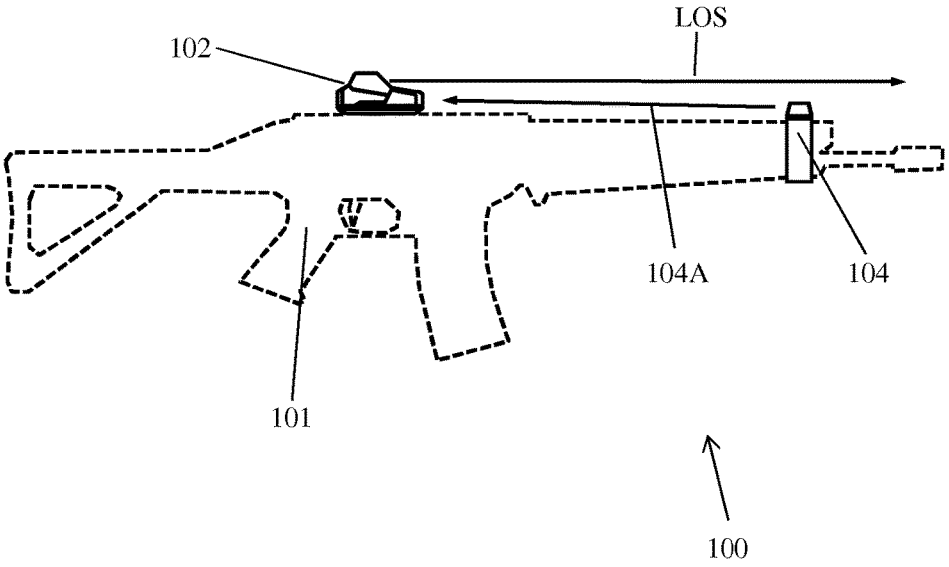
FIG. 1 is a schematic illustration of an optic sight system according to some embodiments of the present invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

A computing device as described below may include a controller that may be, for example, a central processing unit processor (CPU), a chip or any suitable computing or computational device, an operating system, a memory unit, a storage unit, an input devices unit and an output devices unit, e.g., a monitor or display screen. Such computing device may be adapted to carry out embodiments of the present invention.

An operating system as described below may be or may include any code segment designed and/or configured to perform tasks involving coordination, scheduling, arbitration, supervising, controlling or otherwise managing operation of a computing device, for example, scheduling execution of programs. The operating system may be a commercial operating system. A memory unit such as that described below may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. The memory unit may be or may include a plurality of, possibly different memory units.

Executable code such as the code used by the computing device and stored in the memory unit may be any executable code, e.g., an application, a program, a process, task or script. The executable code may be executed by a controller possibly under control of an operating system. Where applicable, a processor executing the executable code may carry out operations described herein in real-time. The computing device and the executable code may be configured to update, process and/or act upon information at the same rate the information, or a relevant event, are received. In some embodiments, more than one computing devices may be used. For example, a plurality of computing devices that include components similar to those included in a single computing device may be connected to a network and used as a system. For example, generating and maintaining a model as described herein, or verifying a session may be performed in real-time by the executable code when executed on one or more computing.

A storage unit as described below may be or may include, for example, a hard disk drive, a floppy disk drive, a Compact Disk (CD) drive, a CD-Recordable (CD-R) drive, a universal serial bus (USB) device or other suitable removable and/or fixed storage unit. Content may be stored in the storage unit and may be loaded from the storage unit into the memory unit where it may be processed by the controller device.

Input devices as described below may be or may include a keypad and a remote control unit's keypad. Input devices may further include a computing unit connected via a data transfer connector, for example, a USB compatible plug. It will be recognized that any suitable number of input devices may be operatively connected to the computing device. Output devices may include a display and a computing unit connected via the USB compatible plug.

Some embodiments of the invention may include an article such as a computer or processor non-transitory readable medium, or a computer or processor non-transitory storage medium, such as for example a memory, a disk drive, or a USB flash memory, encoding, including or storing instructions, e.g., computer-executable instructions, which, when executed by a processor or controller, carry out methods disclosed herein.

Unless explicitly stated, the method embodiments described herein are not constrained to a particular order or sequence. Additionally, some of the described method embodiments or elements thereof can occur or be performed at the same point in time. Where applicable, the described method embodiments may be carried out or performed in real-time. A system including one or more components as described below may process data and events at the rate data and events are received by the system.

Reference is made now to FIG. 1, which is a schematic illustration of optic sight system 100, according to embodiment of the present invention. Optic sight system 100 comprises optic sight unit (OSU) 102 and optic sight remote control unit (OSRCU) 104, built, operable and installable according to embodiments of the present invention. OSU 102 and OSRCU 104 are adapted to be installed on a rifle, such as rifle 101, for example on installation Picatinny or Weaver rail type, so that OSU 102 is disposed at the rear part of rifle 101 and OSRCU 104 is adapted to be disposed close to the front part of rifle 101. As used throughout this application, the rear part of a rifle or the front part of a rifle are denoted with respect to the shooting direction of the rifle, so that, when a rifle is held pointing from a user to the shooting direction, the rear part is close to the user and the front part is further from the user. OSU 102 may be disposed to conveniently allow aiming through it, and conveniently and accurately operate its control buttons even in the dark or in operation, as is explained in details below. OSRCU 104 may be disposed close to the front end of rifle 101, where typically the front hand of the rifle's user is holding the rifle, to allow easy operation of control buttons located on OSRCU 104. OSRCU 104 is disposed on rifle 101 so that a line of sight 104A between OSRCU 104 and OSU 102 is enabled, to allow stable connection between these units. OSRCU 104 may be formed to allow easy installation or removal of the unit onto/from the rifle as well as easy and accurate operation of the control keys on it, as is explained in details below.

Figure 2:
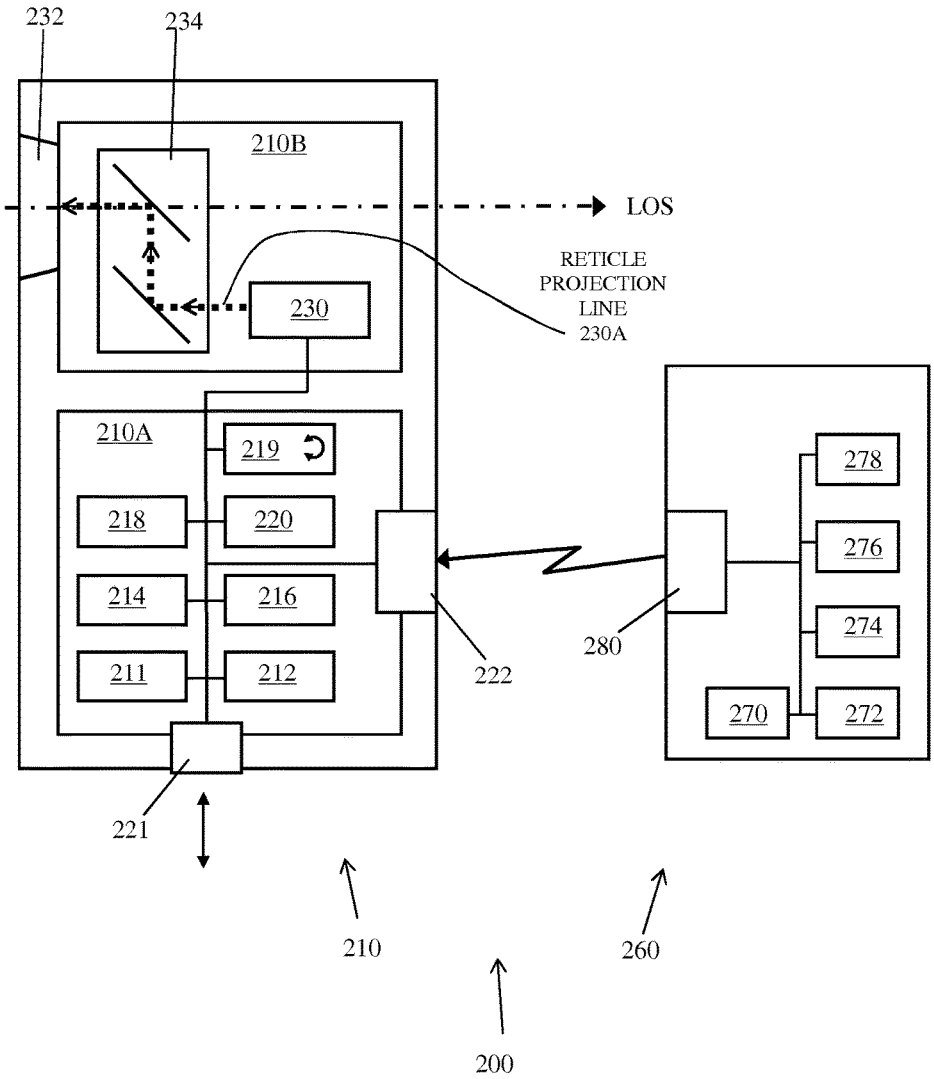
FIG. 2 is a schematic block diagram of a system for operating a remote-controlling optic sight unit, according to some embodiments of the present invention.

Reference is made now to FIG. 2, which is a schematic block diagram of system 200 for operating a remote-controlling optic sight unit 210, according to some embodiments of the present invention. System 200 comprises optic sight unit 210 and remote control unit 260. Optic sight unit 210 may be similar to OSU 102 (FIG. 1) and remote control unit 260 may be similar to OSRCU 104 (FIG. 1).

Optic sight unit 210 may comprise electronic section 210A and optical section 210B. Electronic section 210A may comprise controller unit 211, memory unit 212, storage unit 214, keypad unit 216, power source unit 218, backup power source 220, motion sensing unit 219 comprising at least one motion sensor, receiver 222 and reticle projecting unit 230, which is also part of optical section 210B. Optic sight unit 210 may further comprise communication and recharging port 221, for example a standard USB port, adapted to enable communication with electronic section 210A and charging of power source unit 218. All units of electronic section 210A may be in operational communication with each other, as may be dictated by their role and functionality. For example, all units may be connected to communication and recharging port 221 for receiving electrical power, all units may be connected to power source unit 218 and to backup power source 220; controller unit 211 may be connected to memory unit 212 and storage unit 214 for storing and fetching data; controller unit 211 may further connected to keypad unit 216 for receiving control and/or data input from a user; controller 211 may be connected motion sensor 219 for receiving motion indications; controller 211 may be connected to receiver 222 for receiving remote control signals for example from remote control unit 260, etc. The motion indications may initiate a change of the optic sight assembly from dormant state to active state and thereby, for example, activate projection of the reticle onto the viewing window, or changing the brightness of the reticle image. Changing the stat of the optic sight due to signal from the motion sensor may be if the signal exceeds a predefined level, or when a combination of a series of motion signals matches a pattern indicative of a motion that requires transfer of the optic sight assembly from dormant state to operational active state. Change in state of the optic sight assembly based on a predefined pattern of a series of signals from the motion sensors is highly efficient especially for allowing the system to ignore accidental or negligible motions the optic sight assembly may be subject to even when the user holding a gun with the assembly is in rest.

USB port 221 may enable a user to define and/or change user definable operation parameters of an optic sight such as optic sight 210 (FIG. 2), such as sleep mode timer value, low battery warning time, levels of reticle brightness and the like, thus allowing the user to 'personalize' the operation of the optic sight as it may fit his/her needs and requirements.

Optical section 210B may comprise, additional to reticle projecting unit 230, optical redirecting and combining unit 234 and viewer window 232. Reticle projecting unit 230 may be located in optical section so that an image projected by it may be screened onto an optical entry face of unit 234. Reticle projecting unit 230 may project, along reticle projection line 230A, a reticle image. That image may be redirected onto optical combiner within unit 234 so as to screen an image, preferably of a reticle, onto viewing window 232 while allowing a line of sight LOS through viewing window and unit 234 towards an optional target.

Remote control unit 260 may comprise controller 270 in operational communication with memory unit 272, storage unit 274, keypad unit 276, power source 278 and transmitter 280. Transmitter 280 may be configured to transmit signals in a form and medium receivable by receiver 222 of electronic section 210A.

Figure 3A:
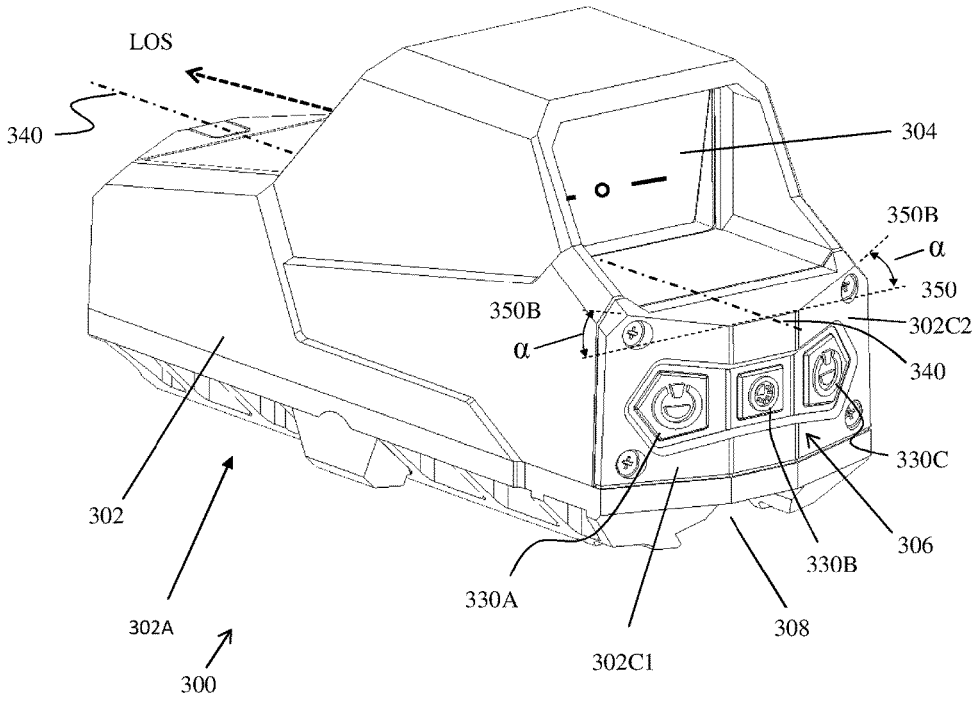
FIGS. 3A and 3B are schematic 3D illustrations of an optoelectronic optic sight as seen from the rear end and front end, respectively, according to some embodiments of the present invention.
Figure 3B:
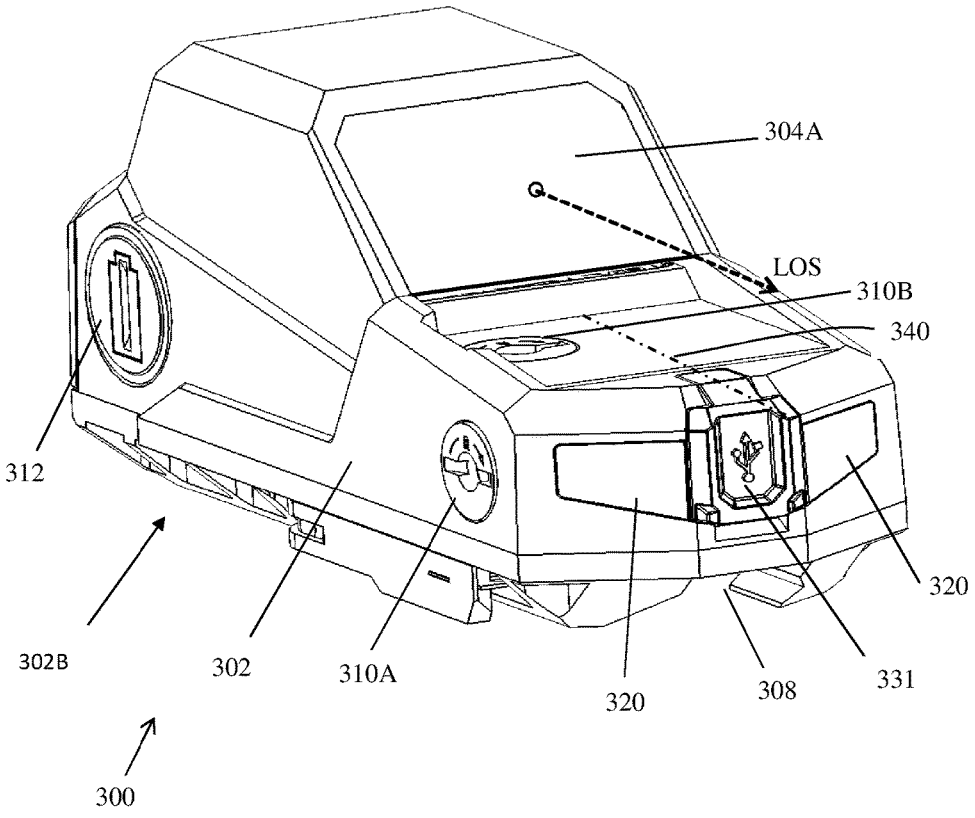

Reference is made now to FIGS. 3A and 3B, which are schematic 3D illustrations of optoelectronic optic sight 300 as seen from the rear end and front end, respectively, according to embodiments of the present invention. Optic sight 300 comprises casing 302, aiming window 304, and aiming window as seen from the front end 304A, control keys 306, mounting rail receptacle 308, optic sight windage and elevation adjustment means 310A and 310B, respectively, battery compartment cover 312, remote control signal receive windows 320 and communication and recharge port, such as communication port 221 (FIG. 2) under port cover 331.

Optic sight casing 302 is formed and designed to not include any operating button or lever protruding on the side faces 302A and 302B, providing by this casing free of accidental and unintentional activation of buttons or levers or changing of the state of such buttons or levers. The only operational features accessible on the side faces, in the casing of the example of FIG. 3A, are located on side face 302A—main power source battery compartment cover 312 and windage adjustment means 310A, have their faces flattened with the surrounding surface of side face 302A and are made to be dealt with off the battle field before or in preparation to operation. Casing 302 is further designed to reduce sharp corners and sharp edges, in order to avoid inconvenience or mishaps during operational situations, keeping in mind that the optic sight, when installed in a weapon and used during an operation, is likely to be close to or in touch with other equipment articles worn or carried by the user. Casing 302 may be made of any material suitable to provide strong, rigid and preferably dust and water proof case for the interior of the optic sight, such as Ixef® PARA (polyarylamide).

Viewing window 304 is made with wide field of view of 15° to enable the user to quickly and easily identify and acquire a required target in the window, even during dynamic situations. It will be apparent to those skilled in the art that a viewing angle of value other than 15° which provides wide enough field of view lies within the scope of this invention as well. The wide FOV may enable the user to follow and acquire a target without needing to look outside of the aiming window of the optic sight. The optoelectronic system comprised in optic sight 300, such as system 200, is adapted to project to the user, in the viewing window, a reticle to facilitate easy and accurate aiming at the target. The reticle may be of any desired form and size, as may be required. The reticle is projected by a projecting assembly, such as projecting unit 230 along with optical redirecting and combining unit 234 (FIG. 2) in the optic sight, and may be shaped to the desired form and size using one of several known means. The reticle may be projected to the user by an optical redirecting and combining unit, thus allowing presenting a reticle on the line of sight (LOS) of the user while enabling the user to see the view in front of him/her so that when a target is centered at the reticle image, the gun on which the optic sight is properly installed aims at the target.

Figure 3C:
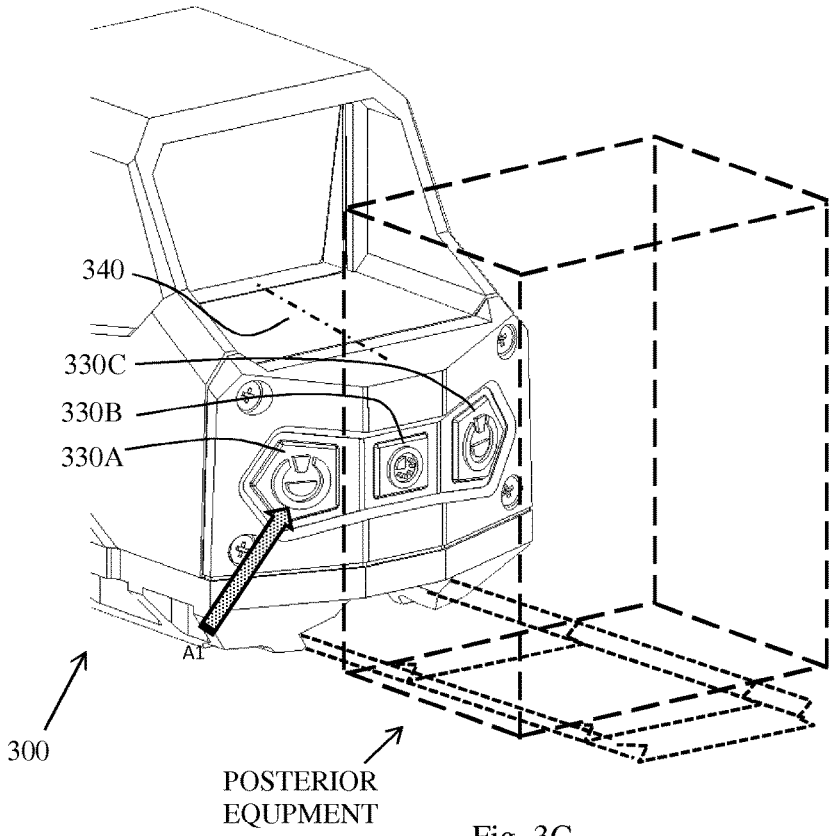
FIGS. 3C and 3D exemplify the ease of access to rear control buttons on an optic sight when additional equipment is installed behind the optic sight, according to some embodiments of the present invention.
Figure 3D:
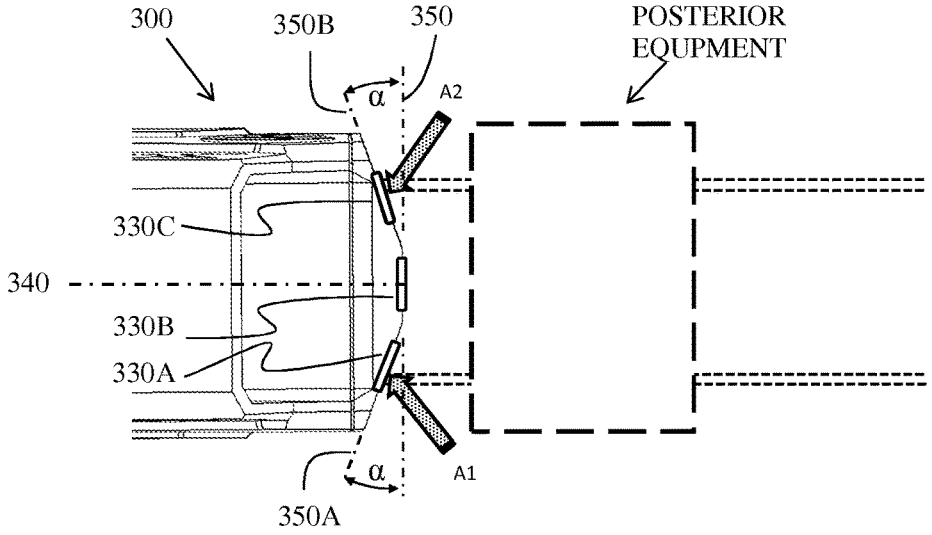

As seen in FIGS. 3A and 3D, facets 302C1 and 302C2 are made on the rear side of casing 302 and are inclined by angle $\alpha$ from reference line 350 which is perpendicular to longitudinal line 340 of optic sight 300. Thereby facets 302C1 and 302C2 are easily accessible from both sides of longitudinal line 340 even when additional equipment is installed behind optic sight 300. Angle α may be in the range of 15°-30° and preferably 20°, to enable easy and accurate access to control buttons 330A and 330C (FIG. 3C) even during operation in a battle field also when additional equipment is installed behind optic sight 300, e.g. posterior equipment as seen in FIGS. 3C and 3D and explained in details herein below.

Reference is made to FIGS. 3C and 3D, which exemplify the ease of access to rear control buttons located on facets 302C1 and 302C2 when additional equipment is installed behind optic sight 300, according to some embodiments of the present invention. FIGS. 3C and 3D depict the rear part of optic sight 300 with posterior equipment installed right behind optic sight 300 in isometric view and top view, respectively, according to some embodiments of the present invention. Rear operation control buttons 330 comprise, according to some embodiments of the present invention, two in-field control buttons 330A and 330C, disposed on inclined facets 302C1 and 302C2, respectively. Operation control button 330B may have functions assigned to it which may not require in-field access, such as sleep mode on/off, night vision mode on/off, sleep mode timer 10 sec/10 min, and the like. As exemplified by arrows A1 and A2, easy and convenient access to operation control buttons 330A and 330C is available even when posterior equipment is installed close behind optic sight 300. In-field essential functionalities that may be assigned to control buttons 330A and 330C are turn on/turn off the optic sight unit and change the brightness of reticle. Changing the brightness may be, for example, by a cyclic process from most bright through lowering levels of brightness where each click on the button changes the level, or in a reverse order. This way, the user need not look at the buttons but rather just place a finger on the button and click it the required number of times, while his/her eyes and attention are on the target.

Figure 4A:
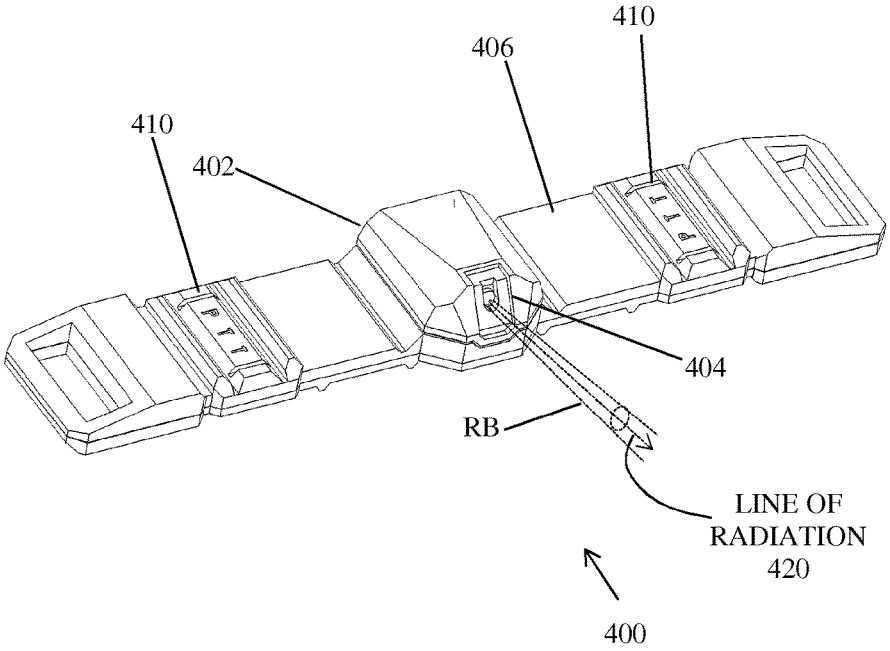
FIGS. 4A and 4B are schematic illustrations of a remote control unit, shown in wide open un-deployed and in deployed positions, respectively, according to some embodiments of the present invention.
Figure 4B:
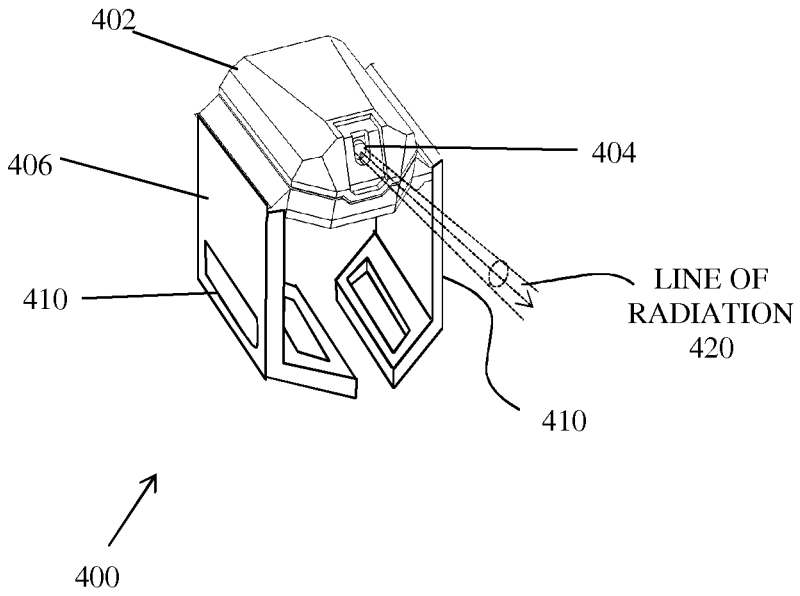

Reference is made now to FIGS. 4A and 4B, which are schematic illustrations of remote control unit 400, shown in wide open un-deployed and in deployed positions, respectively, according to some embodiments of the present invention. Remote control unit 400 may be built and operable similar to remote control unit 260, described above with respect to FIG. 2. Remote control unit 400 may comprise central unit 402, comprising most of the units described as comprised in remote control unit 260, except for keypad units 410 which are disposed on installation band units 406 on both sides of central unit 402, located along installation band units 406 at locations that will make the operation of the keys in keypads 410 easy and intuitive for a user when remote control unit is installed at the front portion of a weapon such as a rifle. Each of keypads 410 may comprise at least one control button. The location and functionality the control buttons in keypads 410 may be configured to have different functions such as turn on the optic sight unit and change the brightness of reticle. Yet, preferably the control button(s) of the two keypads 410 may have identical functionality, thus enabling use of a standard optic sight system for both right and left handed users. Installation bands 406 may provide firm and steady installation means of remote control onto a rifle's barrel.

Installation of remote control unit will be done so that the radiation beam RB of remote control transmitter 404 is aimed at the receiver windows of the optic sight. The opening angle of RB may be set to a very narrow angle, such as 10° (e.g., ±5° spatial opening angle around central aiming line 420) so that the amount of radiation is minimized to avoid or minimize exposure of this radiation to hostile troops. The format of coding of data onto the transmitter beam may be selected to be unique to the receiver in the optic sight, to disable option of false or unintentional activation/control of one optic sight by the remote control unit of another user, or by third parties.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. An optic sight assembly (100, 200) for installation on a rifle comprising:

an electro-optical optic sight unit (102, 210) disposed at a rear part of the rifle comprising:
- a controller unit (211);
- a remote control receiver (222); and
- an electro-optical unit (234) to project a reticle image;
- a casing;
- at least one first control button (216, 330A/330C) disposed on at least one inclined facet (302C1/302C2) on a rear side of the casing, wherein the facet is inclined by an angle α from a plane perpendicular to a longitudinal line of the optic sight assembly; and a corresponding remote control unit (104, 260) disposed at a front part of the rifle comprising:
- a remote control controller (270);
- a remote control transmitter (280) to transmit control signals to the remote control receiver; and
- a keypad unit (276) to enable entering control commands to the remote control unit;

wherein the electro-optical optic sight unit is adapted to receive control signals from the remote control unit.

2. The optic sight assembly of claim 1, further comprising at least one motion sensor (219) to sense motion of the optic sight assembly and to issue a signal indicative of the motion to the optic sight controller.

3. The optic sight assembly of claim 2, wherein when the input from the motion signal is one of: a signal exceeding a predefined level or a series of signals matching a predefined pattern of signals, the state of the optic sight assembly may be changed from dormant to active.

4. The optic sight assembly of claim 1, wherein the angle α is in the range of 15° 30°.

5. The optic sight assembly of claim 1, wherein the at least one first control button is adapted to enable control of at least one of turn on/turn off the optic sight assembly and change a brightness of the reticle image.

6. The optic sight assembly of claim 4, further comprising a second control button (216, 330B) disposed on the rear side of the optic sight assembly substantially in a middle of the rear side of the casing.

7. The optic sight assembly of claim 6, wherein the second control button is adapted to control at least one of sleep mode on/off, night vision mode on/off, sleep mode timer.

8. The optic sight assembly of claim 1, further comprising a port disposed on a front end of the casing, the port adapted to enable serial communication with the controller unit of the optic sight unit and to provide charging power to a rechargeable battery of the optic sight assembly.

9. The optic sight assembly of claim 8, wherein the port is a USB port.

10. The optic sight assembly of claim 9, wherein the port is adapted to enable a remote computing unit connected via the port to modify values of the optic sight assembly.

11. The optic sight assembly of claim 10, wherein the values are at least one of sleep mode timer value, low battery warning time and levels of reticle brightness.

12. The optic sight assembly of claim 1, wherein the remote control unit is installed on the front part of the rifle such that a radiation beam from the remote control transmitter (280, 404) is aimed towards the optic sight unit, wherein the angle of the radiation beam is 10°.

13. The optic sight assembly of claim 12, wherein control commands entered at the remote control unit are coded on the radiation beam.

14. The optic sight assembly of claim 13, wherein a coding of the control commands is unique to the optic sight unit and to the corresponding remote control unit.

* * * * *